US012286263B2

(12) United States Patent
Naveau et al.

(10) Patent No.: US 12,286,263 B2
(45) Date of Patent: Apr. 29, 2025

(54) FLAT-BOTTOMED PLASTICS CONTAINER

(71) Applicant: SIDEL PARTICIPATIONS, Octeville-sur-Mer (FR)

(72) Inventors: Laurent Naveau, Octeville-sur-Mer (FR); Wilfried Hermel, Octeville-sur-Mer (FR); Céline Vautier, Octeville-sur-Mer (FR); Michel Boukobza, Octeville-sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 0 days.

(21) Appl. No.: 18/204,468

(22) Filed: Jun. 1, 2023

(65) Prior Publication Data

US 2023/0312157 A1 Oct. 5, 2023

Related U.S. Application Data

(62) Division of application No. 17/718,253, filed on Apr. 11, 2022, now Pat. No. 12,091,209.

(30) Foreign Application Priority Data

Apr. 13, 2021 (FR) ..... 2103800

(51) Int. Cl.
*B65D 1/02* (2006.01)

(52) U.S. Cl.
CPC ..... *B65D 1/0284* (2013.01); *B65D 1/0261* (2013.01); *B65D 1/0276* (2013.01); *B65D 2501/0081* (2013.01)

(58) Field of Classification Search
CPC ..... B65D 1/0276; B65D 1/0261; B65D 2501/0081; B65D 79/0081; B65D 1/0284
See application file for complete search history.

(56) References Cited

U.S. PATENT DOCUMENTS

| | | | | |
|---|---|---|---|---|
| 4,197,954 | A * | 4/1980 | Oltman | B65D 1/0276 215/373 |
| 6,932,228 | B1 * | 8/2005 | Darr | B65D 1/0276 206/509 |
| D527,649 | S * | 9/2006 | Sasaki | D9/531 |
| 8,567,624 | B2 * | 10/2013 | Coley, Jr. | B65D 23/102 215/384 |
| 10,266,300 | B2 * | 4/2019 | Boukobza | B65D 1/0276 |
| 2010/0000963 | A1 * | 1/2010 | Inomata | B65D 1/0223 215/383 |

* cited by examiner

*Primary Examiner* — Nathan J Jenness
*Assistant Examiner* — Jennifer Castriotta
(74) *Attorney, Agent, or Firm* — Blake T. Hudson; Stephanie Davy-Jow

(57) ABSTRACT

Described is a container made of plastics material, provided with a body and with a bottom in the continuation of the body at a lower end of the body. The bottom has an oblong curved contour and includes a seating surface forming a standing plane of the container. The standing plane has an oblong closed curved shape extending along a longitudinal median axis and a transverse median axis. The standing plane also has an arched area extending from the seating surface as far as a central zone of the bottom, the arched area delimiting a concavity oriented toward the outside of the container.

20 Claims, 12 Drawing Sheets

FLAT-BOTTOMED PLASTICS CONTAINER

CROSS-REFERENCE TO RELATED APPLICATIONS

This application is a Divisional of US application having Ser. No. 17/718,253, filed on Apr. 11, 2022. This application also claims priority to French application having serial number 2103800 filed on Apr. 13, 2021, which are entirely incorporated herein by reference.

FIELD OF INVENTION

The field of the invention is that of the design and manufacture of containers obtained by blow-molding or stretch-blow-molding a blank made of plastics material, such as PET (polyethylene terephthalate). The blank corresponds to a preform or to an intermediate stage of the container being manufactured. The invention relates more particularly to the manufacture of flat containers, that is to say of containers having a laterally flattened body and an oval bottom for example.

BACKGROUND OF THE INVENTION

Containers can be characterized by the shape of their bottom, which has an oblong contour in a view of the container from below.

This type of container has an inherent risk of instability in an upright position, and a risk of tipping about an axis parallel to the long length of the bottom.

In practice, it has been found that the natural instability (on account of the flat shape) of such a container is frequently compounded by an instability caused by quality defects in the taking of the impression of the bottom.

One of the causes of this instability is the difference in distribution of the plastics material that arises during the blow-molding of the blank.

Specifically, during the molding of the bottom of the container, the plastics material of the blank needs to stretch in the mold and be distributed so as to closely follow the shape of the bottom of the mold. In the case of a flat container, i.e. a container which has an oval bottom, the plastics material of the blank first of all reaches the central part of the bottom while it is being stretched, then it is stretched and reaches the lateral edges of the bottom (the two opposite edges of the bottom which are closest to a central point of the bottom) more rapidly and to a greater extent than the longitudinal ends of the bottom (the two opposite edges of the bottom which are farthest away from the central point of the bottom), this bottom being oval, meaning that its greatest dimension, which lies in a first direction, is much greater than its dimension in the direction perpendicular to this first direction.

There therefore arises a difference in distribution of the plastics material of the blank for molding the oval bottom. This difference in distribution is likely to cause molding defects or defects in structural strength or material distribution, resulting in the instability of the container set down on its bottom, on account of the bottom not being sufficiently flat.

Solutions exist for obtaining an oval bottom of a flattened container which does not exhibit instability.

A first example of the prior art, illustrated in FIG. 1, shows a bottom of a flat container 91 in a view in transverse section of the bottom set down on a support 93, which shows that the bottom is provided with "feet" 92. Thus, a container 91 provided with feet 92 that are used to stand the container 91 stably on a support 93 can be seen.

Although not very visible, this solution can be considered to be unattractive on account of the feet 92 and the fact that there is not a continuous, integral standing plane of the bottle on the support 93.

In other words, the seating surface of the container, when it is set down vertically on a support 93 and is in contact with this support 93, is not continuous around the perimeter of the bottom of the container 91.

The achievement of a bottom provided with a continuous, or at the very least more or less continuous, standing plane is a desired objective.

Flat containers provided with a continuous standing plane can be obtained via blow-molding a blank in a mold accompanied by boxing of the bottom. In this case, the mold having the impression of the container comprises a boxing insert that is movable in the bottom of the mold. Once the container has been molded or during the molding of this container, the boxing insert deforms the bottom, allowing the achievement of a continuous standing plane.

This technique requires the use of a boxing insert and the achievement of such a continuous standing plane without employing a boxing technique is desired, i.e. the achievement of a continuous standing plane only through blow-molding or stretch-blow-molding a blank in a mold.

SUMMARY OF THE INVENTION

The invention has in particular the objective of overcoming the drawbacks of the prior art.

More specifically, the objective of the invention is to propose a flattened container in which the oval bottom is capable, on account of its shape, of having a continuous standing plane and of having high stability when it is stood upright on its bottom.

Another objective of the invention is to provide such a container which can be obtained with the aid of a simple manufacturing technique, which does not necessarily require the use of a boxing insert.

These objectives, and others which will become apparent below, have been achieved by virtue of the invention, the subject of which is a container made of plastics material, provided with a body and with a bottom in the continuation of the body at a lower end of the body, the bottom having an oblong curved contour and comprising: a seating surface forming a standing plane of the container, the standing plane having an oblong curved shape extending along a longitudinal median axis and a transverse median axis, the seating surface having a width, with a value w, between its distal ends along the transverse median axis; an arched area extending from the seating surface as far as a central zone of the bottom, the arched area delimiting a concavity from the outside of the container; the container having a central axis on which the central zone is centered, wherein, in this container, the seating surface has width reductions that are each situated on one side of the longitudinal median axis, at least at the intersection between the seating surface and the transverse median axis, and wherein the arched area has, for each width reduction of the seating surface, for the one part, an indentation filling said width reduction of the seating surface and forming a concavity from the outside of the container, and, for the other part, a curved portion extending directly from said indentation in the direction of the central zone, and having, in a section plane passing through the central axis and the transverse axis, a section in the form of a circular arc inscribed in a circle, the center of which is situated at a distance, with a value dc, from the central axis along the transverse median axis, with 0.1 w≤dc≤0.3 w.

It has been found, that the curve is not sufficiently pronounced at less than 10%. Above 30%, the curve becomes too abrupt and risks having a detrimental effect on the molding of the seating surface of the container.

By virtue of the shape of its bottom, the container according to the invention exhibits high stability when it is stood upright on its bottom, while being able to be obtained via simple blow-molding or stretch-blow-molding of a blank in a mold with the impression of the container, without a moving part.

In the invention, the significant curvature of the curved portions, in particular compared with conventional curvatures of the bottoms of the prior art on a median transverse section plane, coupled with the indentations, notably improves the proper molding of the containers of the type according to the invention.

Specifically, during the blow-molding of the container, the reliefs of the mold bottom corresponding to the curved portions make it possible to slow down the expansion of the plastics material of the blank on either side of the central zone of the bottom, along the transverse median axis, while the expansion of the plastics material is not slowed down on either side of the central zone along the longitudinal median axis.

In other words, the stretching of the plastics material during blow-molding is contained by the presence of the reliefs of the mold bottom that result from the curved portions in order to avoid excessive accumulation of plastics material at the lateral ends (long sides) of the bottom of the container compared with its longitudinal ends (short sides).

The reliefs of the mold bottom corresponding to the two indentations, behind each curved portion, make it possible to ensure proper distribution, in the parts adjacent to the indentations, of the plastics material that has been slowed down beforehand by the reliefs of the mold bottom resulting from the curved portions.

These indentations are complementary to the curved portions in that they make it possible to avoid a situation in which, during the molding of the bottom of the container, excess plastics material arrives at the seating surface and causes instability of the container, and to contribute to good integrity of the bottom with respect to risks of weakening after the latter has been molded.

This better distribution of the material at the bottom, allowed both by the curved portions and by the indentations, contributes to the natural stability of the container obtained when the latter is stood upright on its bottom.

According to one advantageous embodiment, the arched area has, between the central zone and a width reduction of the seating surface, at least one bulge extending longitudinally and forming, from the outside of the container, a concavity in the arched area.

The bulges help to slow down the expansion of the plastics material during the blow-molding of the container.

According to one advantageous feature, the bulge has a front face proximal to the central zone, a rear face distal from the central zone, and, in between, a flat, the rear face being curved in the direction of the seating surface, the rear face forming all or part of one of the curved portions.

The reliefs of the mold bottom corresponding to this shape of the bulges make it possible to effectively slow down the progression of the plastics material during the molding of the container. This progression of the plastics material is slowed down greatly by the relief corresponding to the front face of the bulge, slowed down to a lesser extent by the relief corresponding to the flat, and this progression is then continued and accompanied via the relief corresponding to the rear face, which curves in the direction of the seating surface.

Advantageously, in a view of the bottom from below, the bottom has:

- a distance, with a value d, along the transverse median axis between the middle of the flat of each bulge and the central axis;
- a distance, with a value I, between the central axis and each distal end of the seating surface along the transverse median axis;

with 40% I≤d≤65% I, preferably with d=50% I.

As explained above, the reliefs of the mold bottom corresponding to each bulge make it possible to retain the plastics material during expansion and help to properly spread out this material to form the bottom. Likewise, the reliefs of the mold corresponding to the bulges enhance the development of the shape of the bottom along the transverse median axis.

If the value "d" is less than 40% of the value "I", the shape of each bulge protrudes excessively and will have a negative effect on the stretching of the plastics material on account of the "wall" that is then created.

If the value of "d" is greater than 65% of the value "I", the bulges will impair the molding of the seating surface.

With a value of "d" equal to 50% of the value "I", the position of each bulge optimizes the effect of the reliefs of the mold bottom corresponding to these bulges.

According to one advantageous feature, the bulge has, at the front face, a height, with a value h, with 0.7 mm≤h≤2.3 mm, and preferably with h=1.5 mm.

The relief of the mold corresponding to the height of the front face, of the flat, and in other words the height of each bulge, helps to increase the length of the developed shape.

Below 0.7 mm, the relief of the mold corresponding to each bulge no longer has a technical effect, and above 2.3 mm, the effect of retaining the material during the expansion thereof becomes too great.

With h=1.5 mm, an advantageous ratio is obtained between the presence of the barrage effect and the absence of excessive retention of the material.

According to one feature, the bulge has an offset positioned between its flat and its rear face, and, in a transverse section, the front face, the flat and the offset together create a crenelated shape, and, at the offset, the bulge has a height, with a value g, with g<h, and preferably with g=0.33 h.

The offset makes it possible to enhance the developed shape of the relief of the mold bottom corresponding to each bulge. Moreover, it has been noted that the reliefs of the mold corresponding to the offsets help to properly spread the plastics material during blow-molding.

With g=33% h, the height of the offset creates a particularly advantageous technical effect.

In addition, the presence of the offset between the flat and its rear face makes it possible to keep the specific shape of each bulge. Thus, subsidence of the plastics material following the blow-molding of the container is avoided.

Preferably, for each bulge and in a median transverse section of the bottom, the rear face has:

- an initial portion adjacent to the flat, the initial portion extending parallel to the arched area;
- a terminal portion adjacent to the seating surface, the terminal portion forming, at its intersection with the seating surface, an angle, with a value a, with a straight line perpendicular to the transverse median axis and inscribed in the median transverse section of the bottom, with 12.5°≤a≤35°, preferably 17.5°≤a≤26°.

The shape of the rear face is thus optimized to allow optimized distribution of the plastics material along the relief of the mold corresponding to the rear faces of the bulges, and then at the seating surface.

In certain embodiments, the bottom comprises, between the mutually facing bulges, and centered on the central zone of the bottom, a dome, the profile of which, parallel to the standing plane, is an elongate oblong shape along the axis ML and which creates, from the outside of the container, a concavity in the arched area.

Such a dome, also referred to as a "push-up", helps to stretch the plastics material when it reaches the bottom of the mold.

Advantageously, the seating surface has a width, with a value w, between the distal ends of the seating surface along the transverse median axis, with 30% w≤y≤45% w.

If y<30% w, the relief of the mold bottom corresponding to the dome does not produce the desired effect.

If y>45% w, the dome takes up too much space.

According to one advantageous feature, the seating surface has a length, with a value t, between its distal ends along the longitudinal median axis, with 25% t≤x≤70% t, preferably with x=54% t.

If the value x is less than 25% of the value t, the stretching of the plastics material as far as the two ends of the arched area along the longitudinal axis risks not taking place correctly.

If the value x is greater than 70% of the value t, the plastics material risks not reaching the seating surface in a sufficient quantity at its lateral parts.

According to one advantageous feature, the arched area comprises four branches that frame each bulge in pairs, each branch extending along an extension axis from the dome to the seating surface, forming, from the outside of the container, a protuberance from the arched area, and, for each bulge, the flat has a length, with a length p, along the longitudinal median axis, and the seating surface has a length, with a value t, between its distal ends along the longitudinal median axis, with 20% t≤p≤40% t, preferably with p=25% t.

The branches help to properly distribute the plastics material, by enhancing the developed shape between the central point and the periphery of the bottom around the bulges, and to stiffen the bottom.

The adapted width of the bulges makes it possible to accommodate the branches in the bottom.

In certain cases, in a view of the bottom from below, each extension axis of a branch forms, with the transverse median axis, an angle, with a value b, with 50°≤b≤63°, preferably with b=57°, and the extension axes of two branches on opposite sides of the longitudinal median axis cross one another on the longitudinal median axis at a point, the two points being spaced apart from one another by a distance, with a value z, with 0.12≤ z/t≤0.35, and preferably with z/t=0.27.

If the value b is greater than 63°, the branches are too spaced apart with respect to the transverse median axis, and the plastics material is not sufficiently stretched to reach the ends of the seating surface along the longitudinal median axis.

If the value b is less than 50°, the two branches are too close together with respect to the transverse median axis and too much amorphous material is located on the seating surface at the long sides thereof, thereby generating stability problems.

According to another embodiment variant, in which the container does not comprise branches, for each bulge, the flat has a length, with a value p, along the longitudinal median axis, and the seating portion has a length, with a value t, between its distal ends along the longitudinal median axis, with 40% t≤p≤65% t, preferably with p=55% t.

By virtue of such a length of the bulges, the technical effects of the reliefs of the mold corresponding to these bulges are improved.

Above 65% t, the length of the flat of each bulge is such that the plastics material does not spread out sufficiently in the direction of the corners of the bottom.

Below 40% t, the plastics material reaches the corners too quickly and an instability effect may occur on account of poor distribution of the plastics material at these points.

According to a second design, in which the arched area does not have a bulge, the bottom comprises, between the mutually facing bulges, and centered on the central zone of the bottom, a dome, the profile of which, parallel to the standing plane, is an elongate oblong shape along the axis ML and which creates, from the outside of the container, a concavity in the arched area, each curved portion extending as far as the dome.

It has been found that this design makes it possible to obtain a container with good distribution of the plastics material at its bottom, the bottom of said container exhibiting greater resistance to the phenomenon of subsidence.

Advantageously, the dome has, along the longitudinal median axis, a maximum length, with a value x, and along the transverse median axis, a maximum width, with a value y, with 2 y≤x≤3.5 y, preferably with 2.4 y≤x≤3 y.

With x<2 y the dome is ineffective.

By contrast, if x>3.5 y, the dome takes up too much space and creates problems on the standing plane.

The effect of stretching the material brought about by the dome is particularly advantageous with the ratio x=between 2.4 y and 3.0 y.

In certain embodiments, the curved portion has a granular texture.

In this way, when the plastics material is stretched, it slides less easily at the relief of the mold corresponding to the curved portions, making it possible to achieve better distribution of the material.

In addition, difficult demolding of the plastics material on the relief of the mold bottoms corresponding to the curved portions is avoided, this bringing about an improvement in the way in which the plastics material is stretched at the bulges.

Lastly, this granular texture makes it possible to conceal any defects that may arise in this zone.

According to a possible additional feature, each indentation has a length, with a value e, along the longitudinal median axis, and the seating surface has a length, with a value t, between its distal ends along the longitudinal median axis, with 65% t≤e≤75% t, preferably with e=70% t.

The main effect of the indentations is to avoid a situation in which, if the container is too heavy, subsidence of the bottom arises on the standing plane, and more specifically subsidence of the amorphous material. The indentations thus make it possible to conceal this subsidence and to avoid a situation in which this subsidence reaches the standing plane and cause a stability problem.

If e<65% t, there is a risk that an instability will occur since the material is stretched less on the relief of the mold bottom corresponding to the indentations.

If e>75% t, the length of the reliefs of the mold corresponding to each indentation does not allow the ends of the bottom made of plastics material to be fed sufficiently.

According to one possible additional feature, for each bulge, the flat has a length, with a value p, along the longitudinal median axis, and the seating surface has a length, with a value t, between its distal ends along the longitudinal median axis, with 40% t≤p≤ 65% t, preferably with p=55% t.

By virtue of such a length of the bulges, the technical effects of the reliefs of the mold corresponding to these bulges are improved.

Above 65% t, the length of the flat of each bulge is such that the plastics material does not spread out sufficiently in the direction of the corners of the bottom.

Below 40% t, the plastics material reaches the corners too quickly and an instability effect may arise on account of poor distribution of the plastics material at these points.

Advantageously, when there are bulges, and along the transverse median axis, each width reduction of the seating surface has a width, with a value u, the seating surface having a residual width, with a value o, with 10% (o+u) ≤u≤o, preferably with u=o.

If u<10% (o+u) a high risk of instability arises.

If u>o, the seating surface cannot be molded properly on account of insufficient stretching of the plastics material.

A further subject of the invention is a mold for manufacturing a container by blow-molding or stretch-blow-molding a blank made of plastics material, the mold comprising a mold bottom having an upper molding surface which corresponds to the impression of the bottom of the container as described above.

BRIEF DESCRIPTION OF THE DRAWINGS

Further features and advantages of the invention will become more clearly apparent from reading the following description of various embodiments of the invention, which are given by way of nonlimiting illustrative examples, and from the appended drawings, in which.

DETAILED DESCRIPTION

Figure 1:
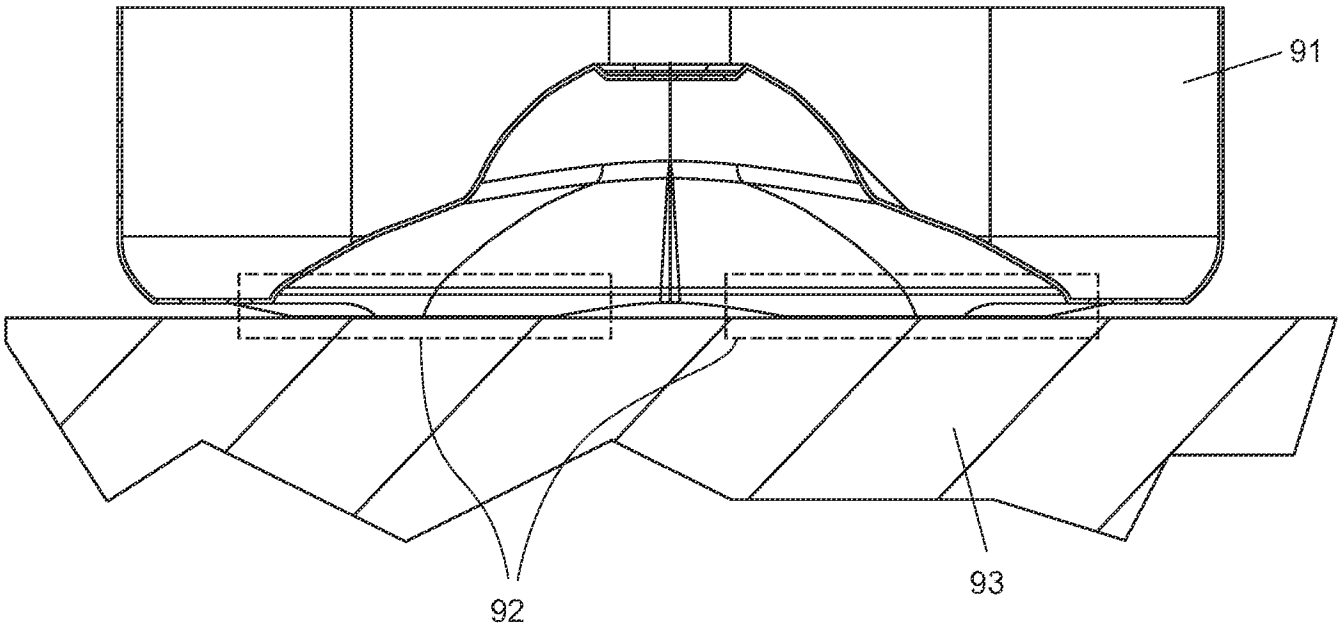
FIG. 1 Prior Art
FIG. 1 is a schematic depiction showing a view in longitudinal section of a bottom of a container according to the prior art.

With reference to FIGS. 2 to 12, a container 1 according to the invention is shown.

The following description of the features of the container 1 according to the invention also applies to the features of a mold for manufacturing this container 1, it being understood that the mold has an impression intended to give the container its final shape and having a complementary shape.

The mold is a mold for manufacturing by blow-molding or stretch-blow-molding a blank made of plastics material. To this end, the mold according to the invention comprises a mold bottom which has an upper surface complementary to the impression of a bottom of the container 1 as described below.

The container 1 according to the invention is a container made of plastics material. More specifically, it is a container made of polyethylene terephthalate.

This container 1 is provided with a body 11 and with a bottom 12 in the continuation of the body 11 at a lower end of the body 11.

The container 1 according to the invention is what is known as a "flat" container.

As is illustrated in FIGS. 2, 4, 5 and 10, the bottom 12 has an oblong curved contour in a view from below.

In other words, the container 1 has smaller dimensions in its width than in its length. The bottom 12 thus comprises two long sides and two short sides.

According to the present embodiments illustrated in FIGS. 2 to 12, the bottom 12 comprises:

- a seating surface 21;
- an arched area 22 extending from the seating surface 21 as far as a central zone 23 of the bottom 12.

The container 1 has a central axis C. The body 11 of the container extends along the central axis C from the bottom 12.

The central zone 23 of the bottom 12 is more specifically centered on the central axis C.

The arched area 22 delimits a concavity from the outside of the container 1.

Moreover, according to the present embodiments in FIGS. 2 to 12, the bottom 1 comprises, between the mutually facing bulges 3, and centered on the central zone 23 of the bottom 12, a dome 5, the profile of which, parallel to the standing plane, is an elongate oblong shape along the axis ML and which creates, from the outside of the container 1, a concavity in the arched area 22, each curved portion 220 extending as far as the dome 5.

Figure 3:
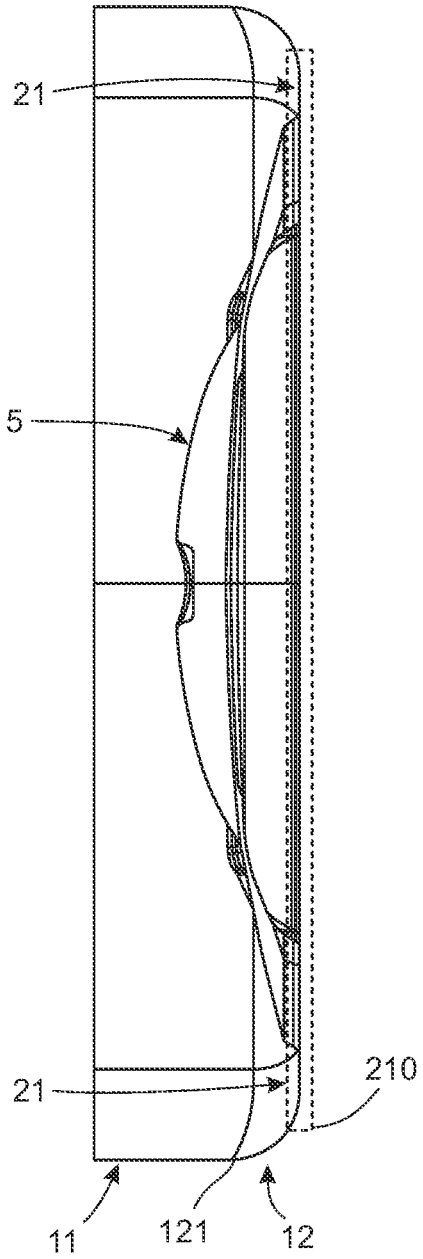
FIG. 3 is a view in longitudinal section of the bottom of the container of the first embodiment.

The seating surface 21 for its part forms a standing plane 210 of the container 1 as is illustrated in FIG. 3.

This standing plane 210 has an oblong curved shape. The shape adopted by the standing plane 210 may also be referred to as oval.

Advantageously, the shape of the standing plane 210 is closed, as is the case in the embodiments illustrated in FIGS. 2 to 9. In other words, the standing plane of the container 1 that is exhibited by the seating surface 21 is continuous, meaning that, around the entire perimeter of the bottom 12, when the container 1 is stood on a support, the entire seating surface is in contact with the support.

With reference to FIGS. 4 to 7, and 10 to 12, the standing plane 210 formed by the seating surface 21 extends along a longitudinal median axis ML and a transverse median axis MT.

The longitudinal median axis ML and the transverse median axis MT cross one another along the central axis C of the container 1.

Figure 10:
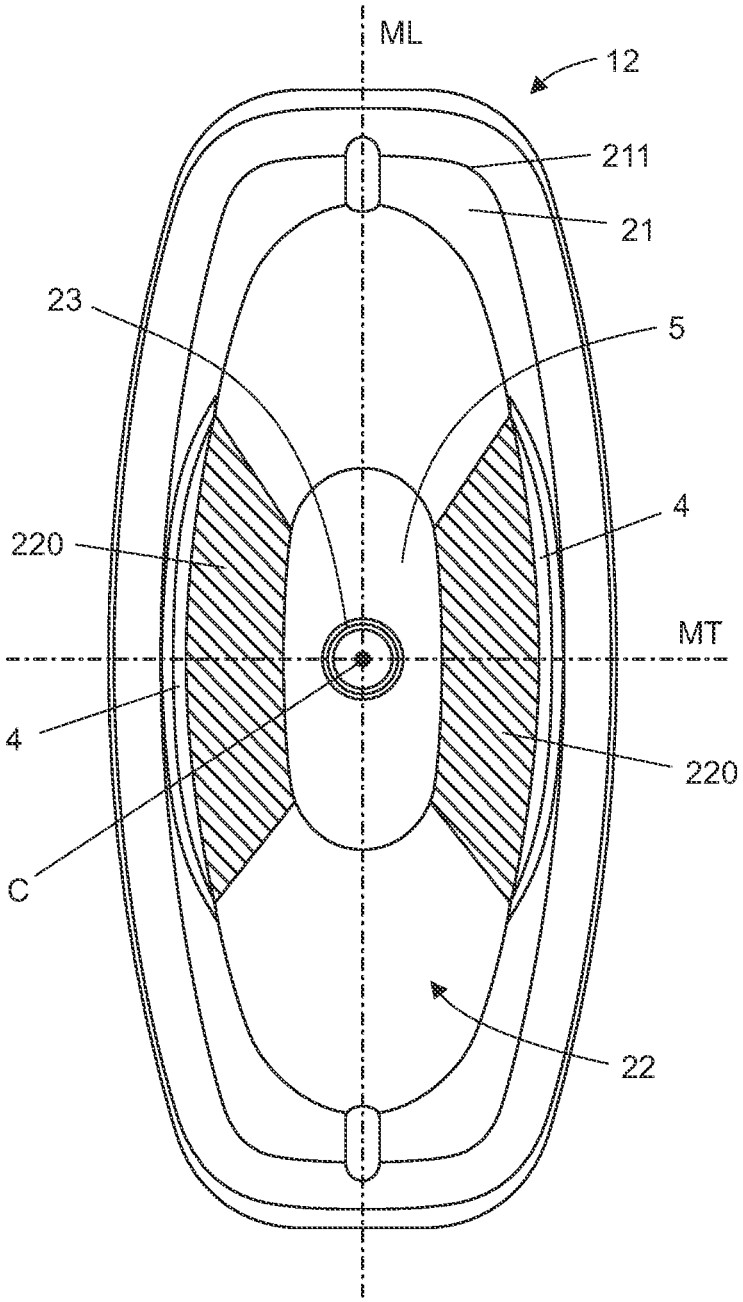
FIG. 10 is a view from below of the bottom according to a third embodiment.
Figure 11:
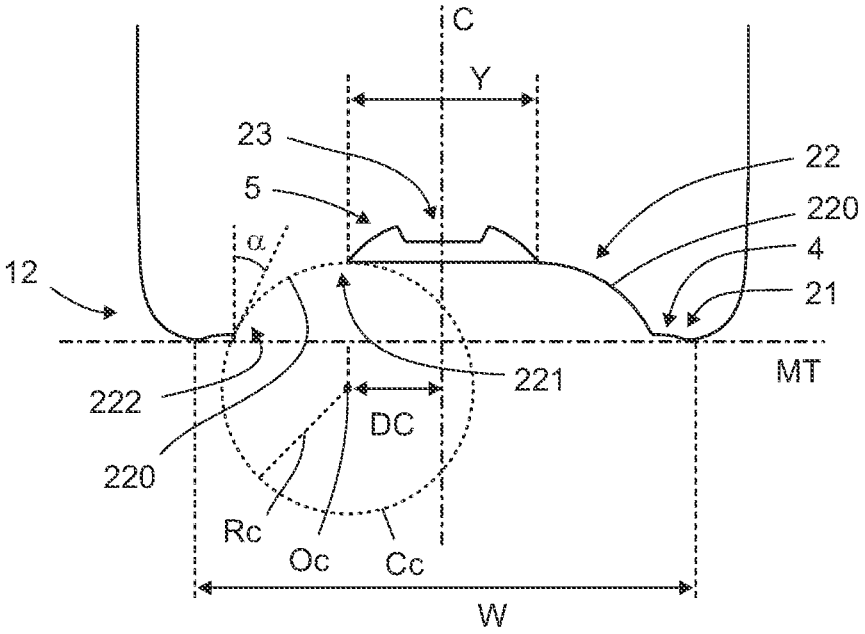
FIG. 11 is a view in section on a transverse plane of the bottom of the third embodiment.
Figure 12:
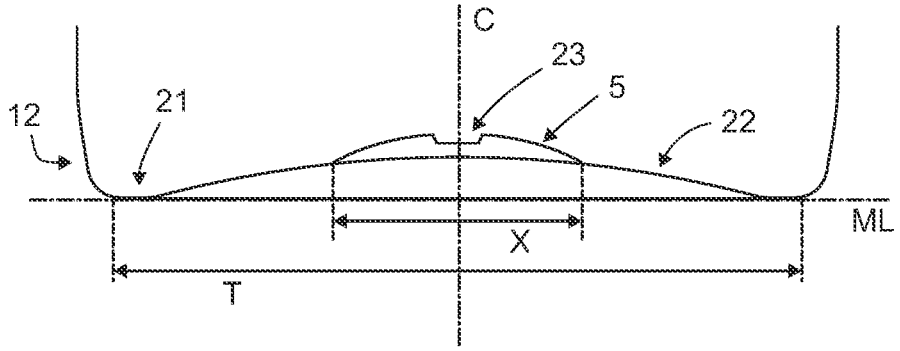
FIG. 12 is a view in section on a longitudinal plane of the bottom of the third embodiment.

According to the embodiment illustrated in FIGS. 10 to 12, the standing plane 210 is not closed. Specifically, the seating surface 21 has two narrowed portions situated at the ends of the seating surface along the longitudinal median axis ML.

The seating surface 21 has a length T, with a value t, between its distal ends along the longitudinal median axis ML, that is to say with the longitudinal median axis ML meeting an exterior contour 211 of the seating surface 21.

The seating portion 21 also has a width W, with a value w, between the distal ends along the transverse median axis MT, that is to say with the transverse median axis MT meeting the exterior contour 211 of the seating surface 21.

Figure 4:
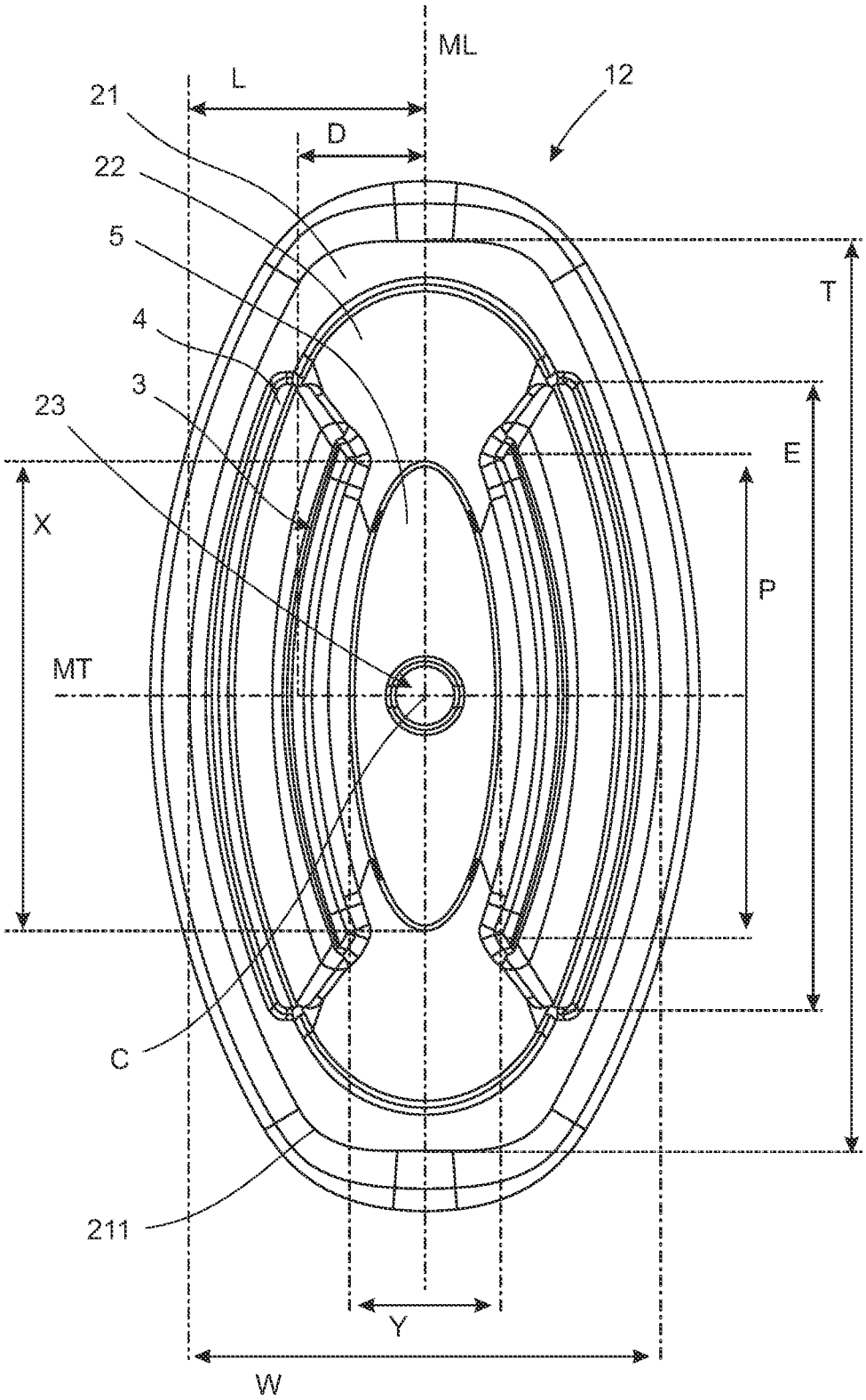
FIG. 4 is a view from below of the bottom according to the first embodiment.
Figure 5:
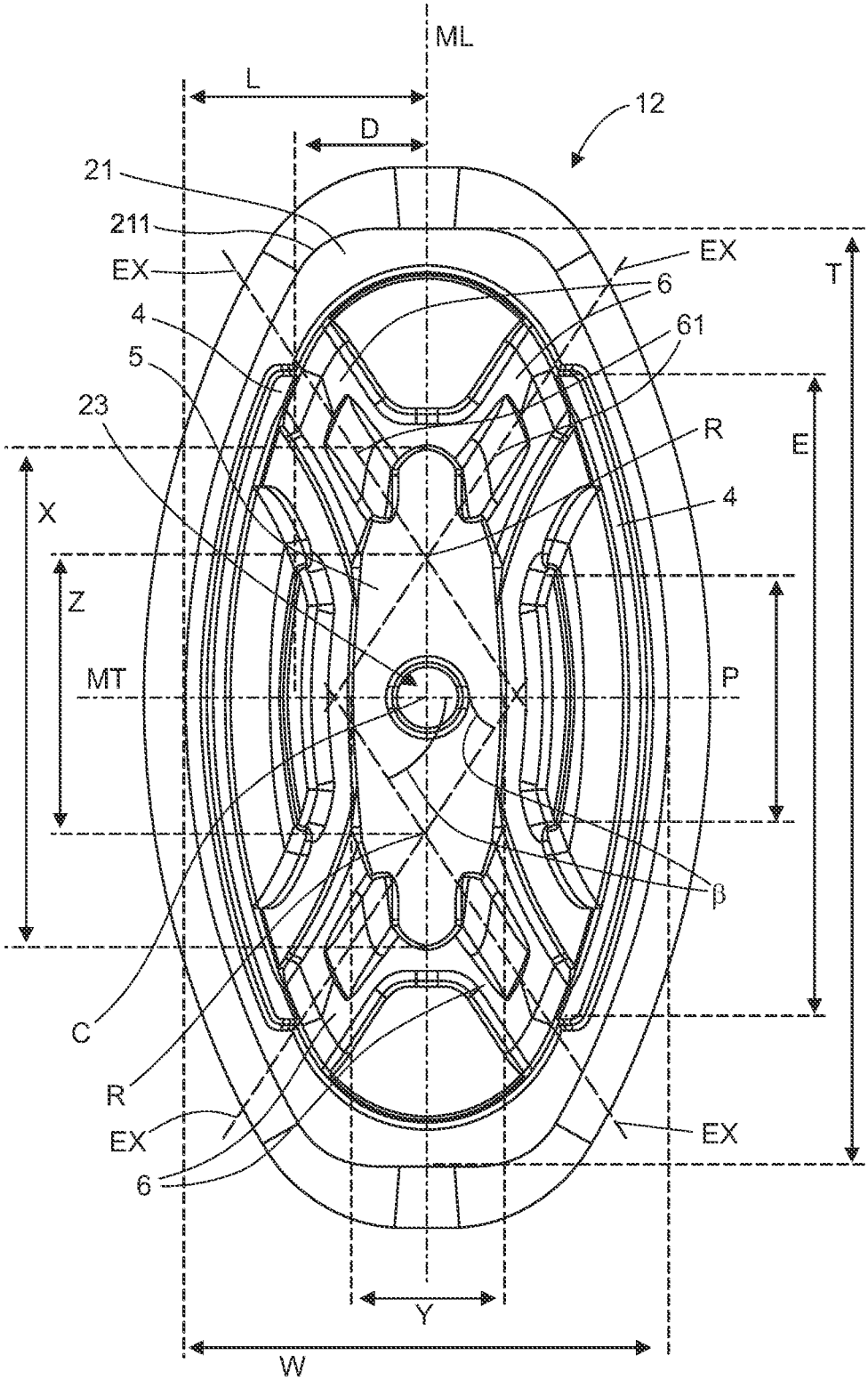
FIG. 5 is a view from below of the bottom of a second embodiment, in which the bottom is provided with branches.
Figure 6:
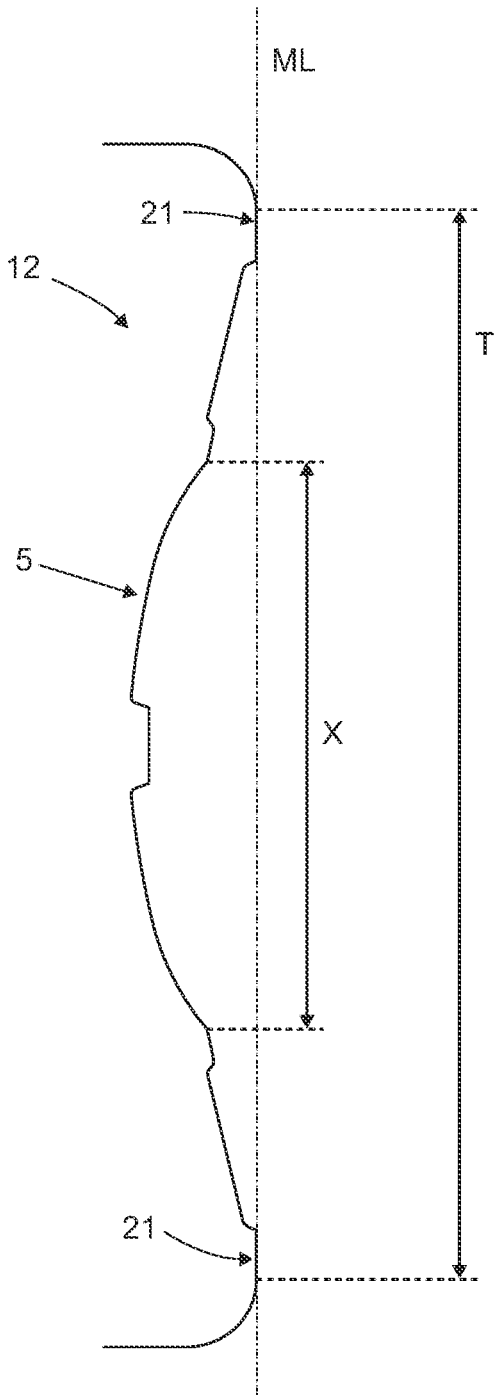
FIG. 6 is a view in section on a longitudinal plane of the bottom of the second embodiment.

More generally, the bottom 12, in a view from below as illustrated in FIGS. 4 and 5, extends along the longitudinal median axis ML and along the transverse median axis MT.

This bottom 12 has a greater dimension along the longitudinal median axis ML than along the transverse median axis MT, thereby giving the standing plane an oblong curved shape.

For each of the present embodiments in FIGS. 2 to 12, the bottom 12 of the container 1 according to the invention exhibits planar symmetry on a first plane in which the transverse median axis MT and the central axis C of the container 1 are inscribed, and planar symmetry on a second plane in which the longitudinal median axis ML and the central axis C of the container 1 are inscribed.

According to the principle of the invention and with reference to FIGS. 2, 4, 5, 7, 10 and 11, the seating surface 21 has width reductions that are each situated on one side of the longitudinal median axis ML. Each width reduction extends longitudinally at least with respect to the central zone 23 along the transverse median axis MT, in each case on one side of the longitudinal median axis ML. In other words, these width reductions extend along the two long sides of the bottom 12, following the longitudinal median axis ML, on either side of the transverse median axis MT, and at least over a distance corresponding to an orthogonal projection of the central zone 23 onto the longitudinal median axis ML.

Moreover, the arched area 22 has, for each width reduction of the seating surface 21:

- an indentation 4 filling said width reduction of the seating surface 21;
- a curved portion 220 extending directly from the indentation 4 in the direction of the central zone 23.

The indentations 4 each delimit, in a transverse section, a cavity from the outside of the container 1.

Figure 7:
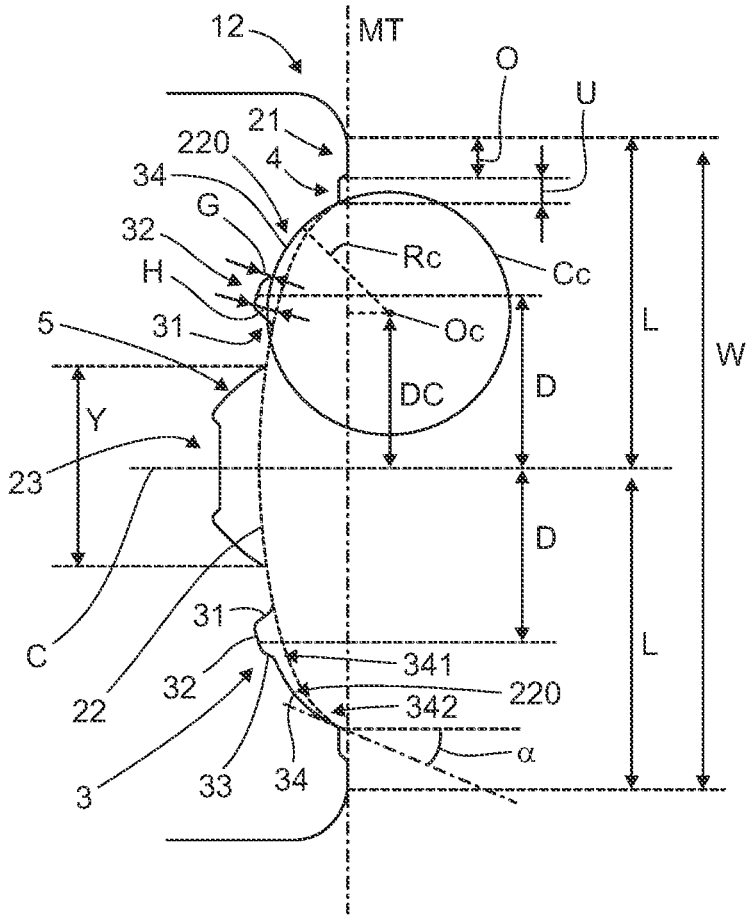
FIG. 7 is a view in section on a transverse plane of the bottom of the second embodiment.
Figure 8:
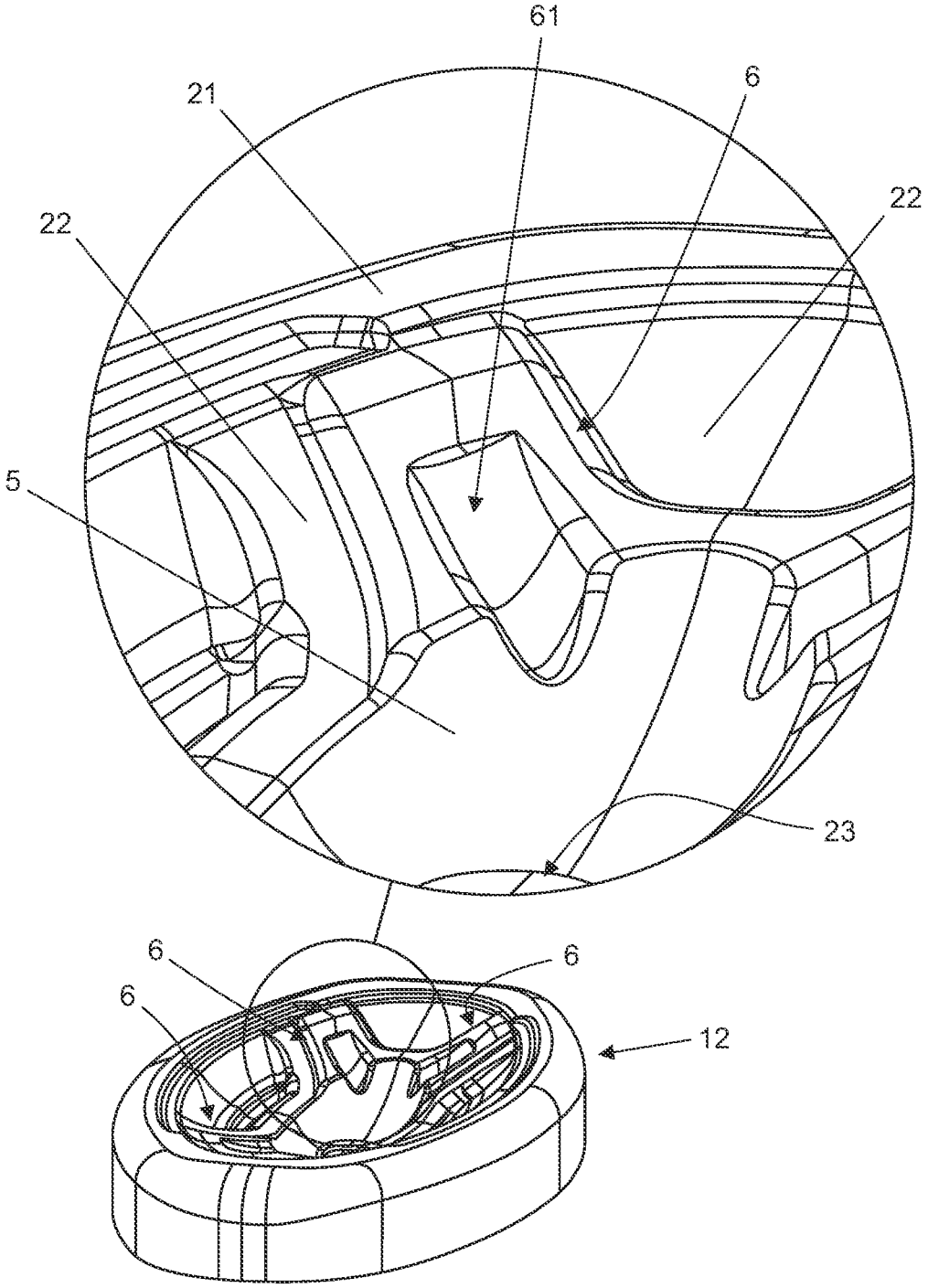
FIG. 8 is a perspective view of the bottom of the second embodiment comprising an inset with a detail on an enlarged scale, illustrating more specifically a branch of the bottom.

As illustrated more specifically in FIGS. 7 and 11, each curved portion 220 extends directly from said indentation 4 in the direction of the central zone 23, and has, in a section plane passing through the central axis C and the transverse axis MT, a section in the form of a circular arc inscribed in a circle Cc, the center of which is situated at a distance DC, with a value dc, from the central axis C, measured along the transverse median axis MT.

Each circle Cc has a radius Rc which may be for example equal to around 5.6 mm.

These curved portions 220 are inscribed, still according to the views in FIGS. 7 and 11, in trapezoids, the short bases of which are oriented toward the central zone and the long bases of which are oriented toward the indentations 4.

The curved portions 220 correspond to parts of the bottom 12 having an accentuated curvature from the indentation and in the direction of the central part 23 compared with conventional arched areaes according to the prior art.

As illustrated by the two embodiments shown in FIGS. 2, 4, 5 and 7, the arched area 22 has two bulges 3, each bulge 3 integrating, as explained in detail below, a curved portion 220.

With reference only to the second embodiment illustrated in FIG. 5, the arched area 22 also comprises four branches that frame each bulge 3 in pairs.

According to FIGS. 4 and 5, the bulges 3 are situated between the width reduction of the seating surface 21 and the central zone 23.

In other words, the bulges 3 frame the central zone 23 along the transverse median axis MT, and thus frame the dome 5.

Figure 2:
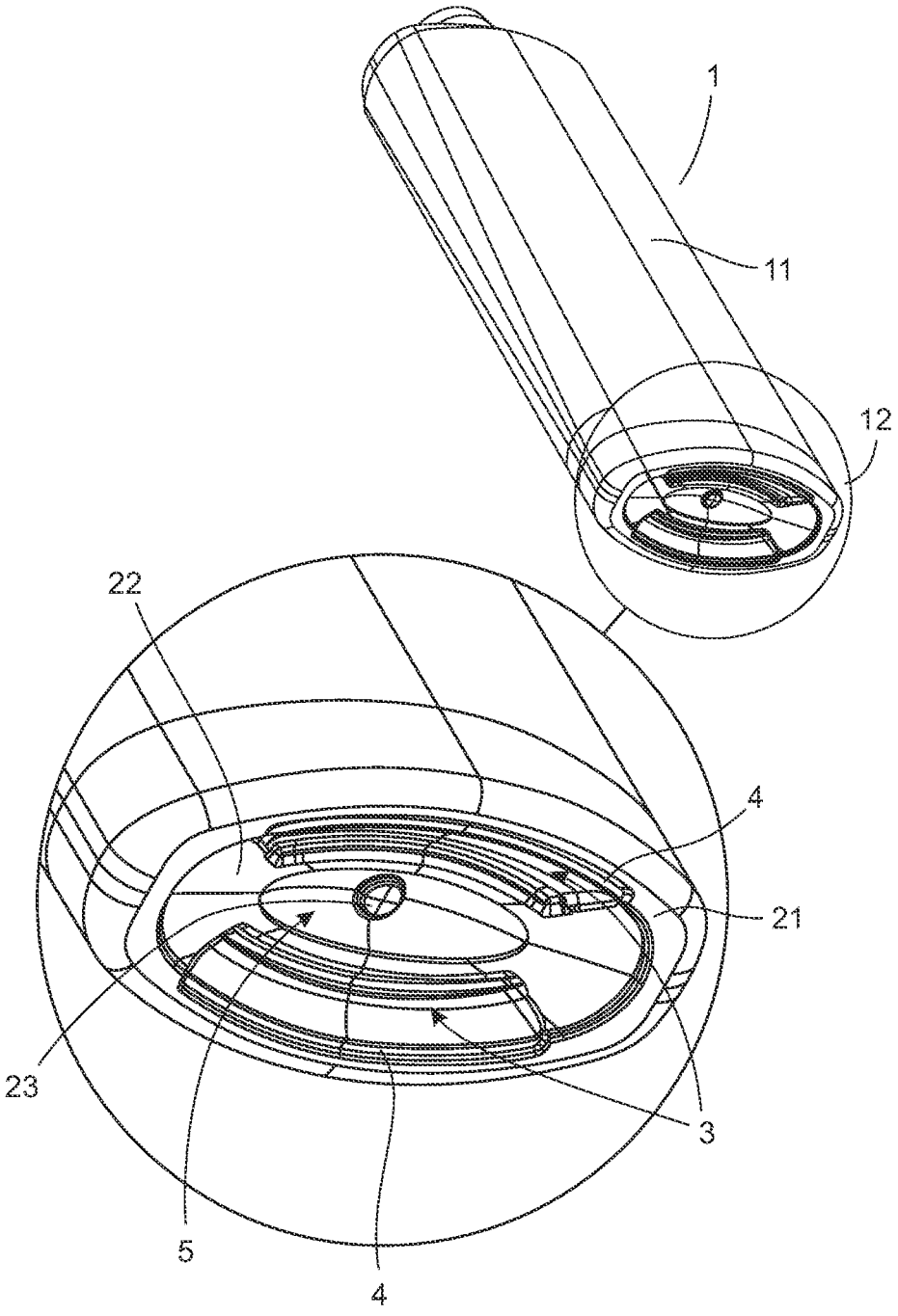
FIG. 2 is a perspective depiction of a flat container according to a first embodiment, showing an inset with a detail on an enlarged scale, illustrating more specifically a bottom of the container.

With reference to FIGS. 2 and 7, the bulges 3 form, from the outside of the container 1, a concavity in the arched area 22. The bulges 3 thus have a relief shape extending inside the volume of the container 1.

With reference to FIGS. 2, 4, 5 and 7, each bulge 3 has:

- a front face 31 which is proximal to the central zone 23;
- a flat 32 extending from the front face 31 in the direction of the seating surface 21;
- a rear face 34 extending from the flat 32, curving in the direction of the seating surface 21, the rear face 34 being distal from the central zone 23.

The rear face 34 of each bulge 3 meets one of the curved portions 220.

With reference to FIGS. 4 and 5, in a view from below, the bottom 12 has:

- a distance D, with a value d, along the transverse median axis MT between a middle of the flat 32 of each bulge 3 and the central axis C;
- a distance L, with a value l, between the central axis C and each distal end of the seating surface 21 along the transverse median axis MT.

In addition, the flat 32 has a length P, with a value p, along the longitudinal median axis ML.

The bulge 3, at the front face 31, has a height H, with a value h.

Each bulge 3, according to the embodiments in FIGS. 2 to 9, also has an offset 33 positioned between its flat 32 and its rear face 34. In this case, the rear face 34 extends more specifically from the offset 33.

In a transverse section of each bulge 3 that is illustrated in FIG. 7, the front face 31, the flat 32 and the offset 33 together take on a crenelated shape.

In other words, the front face 31 protrudes from the arched area 22 in the direction of the flat 32, and the offset 33 extends down from the flat 32 in the direction of the arched area 22.

At the offset 33, the bulge 3 has a height G, with a value g.

Still with reference to FIG. 7, for each bulge 3 and in a transverse section of the bottom 12, on the median plane, the rear face 34 has:

- an initial portion 341 adjacent to the flat;
- a terminal portion 342 adjacent to the seating surface 21.

The initial portion 341 extends parallel to the arched area 22, and more specifically at a projection underlying the arched area 22.

A tangent at the terminal portion 342 for its part forms, at its intersection with the seating surface 21, an angle $\alpha$, with a value a, with a straight line perpendicular to the transverse median axis MT and inscribed in a median plane of the bottom 12 in a transverse section of the bottom 12.

According to the present embodiments, each curved portion 220 has a granular texture.

These curved portions 220 may nonetheless have a smooth texture.

As mentioned above, the arched area 22 has indentations 4.

These indentations 4 delimit, in a transverse section illustrated in FIG. 7, a cavity from the outside of the container 1.

The indentations 4 have a length E, with a value e, along the longitudinal median axis ML.

With reference to FIG. 7, and along the transverse median axis MT, each width reduction of the seating surface 21 has a width U, with a value u, and the seating surface 21 has a residual width O, with a value o.

According to the second embodiment illustrated in FIG. 5, and as was mentioned above, the arched area 22 comprises branches 6.

Each branch 6 extends along an extension axis EX from the dome 5 as far as the seating surface 21, forming a flattened protuberance protruding into the concavity created by the arched area 22 from the outside of the container 1.

According to the present embodiments, each branch 6 also has a central notch 61 creating a concavity in the arched area 22 from the outside of the container.

With reference to FIG. 5, for two branches 6 on opposite sides from one another with respect to the longitudinal median axis ML, and in a view of the bottom 12 from below, the extension axes EX of these two branches 6 cross one another along the longitudinal median axis ML at a point R. The two points R resulting from these respective crossings of the branches 6 are then spaced apart from one another by a distance Z, with a value z.

Moreover, still in a view of the bottom 12 from below, each extension axis EX crosses the longitudinal median axis ML, forming an angle β (BETA), with a value b.

As mentioned above, the arched area 22 comprises a dome 5.

This dome 5 has a profile, parallel to the standing plane, which is an elongate oblong shape along the axis ML.

As illustrated in FIGS. 2 to 7, the dome 5 creates, from the outside of the container 1, a concavity in the arched area 22.

The dome 5 has:

- a length X, with a value x, along the longitudinal median axis ML;
- a width Y, with a value y, along the transverse median axis MT.

With reference to the embodiment illustrated in FIGS. 10 to 12, the bottom 12 does not comprise bulges 3 or branches 6.

According to this embodiment, the curved portions 220 extend directly from the indentations 4 as far as the dome 5. Consequently, in the view illustrated in FIG. 11, each individual section in the form of a circular arc of the curved portion 220 extends from an indentation 4 as far as the dome 5.

With reference to FIG. 11, and in a median transverse section of the bottom 12 passing through the central axis C, each curved portion 220 has:

- an initial portion 221 adjacent to the dome 5;
- a terminal portion 222 adjacent to the seating surface 21.

At its junction with the dome 5, the initial portion 221 extends parallel to the transverse median axis MT.

A tangent to the terminal portion 222 forms, for its part, at the intersection of said terminal portion 222 with the seating surface 21 and in a similar manner to the rear face 34 of the first and the second embodiments, an angle α, with a value a, with a straight line perpendicular to the transverse median axis MT and inscribed in a median plane of the bottom 12 in a transverse section of the bottom 12.

The construction rules below are determined with respect to the features of the bottom 12 according to the two embodiments according to the invention that are illustrated in FIGS. 2 to 9:

- 10% w≤dc≤30% w, preferably with dc=20% w;
- 40% l≤d≤65% l, preferably with d=50% l;
- 30% w≤y≤40% w;
- 2.5 y≤x≤3.5 y, preferably with x=3 y;
- 30% t≤x≤70% t, preferably with x=54% t;
- 0.7 mm≤h≤2.3 mm, and preferably with h=1.5 mm;
- g<h, and preferably with g=33% h;
- 12.5°≤a≤22.5°, preferably with a=17.5°;
- 65% t≤e≤75% t, preferably with e=70% t;
- 10% (o+u)≤u≤o, preferably with u=o.

With respect to the first embodiment illustrated in FIG. 4, in which the bottom 12 does not comprise a branch 6, the following more specific rule applies: 40% t≤p≤65% t, preferably with p=55% t.

With respect to the second embodiment illustrated in FIG. 5, the following more specific rules apply to the bottom 12: 20% t≤p≤40% t, preferably with p=25% t; 0.12≤z/t≤0.35, and preferably with z/t=0.27; 50°≤b≤63°, preferably with b=57°.

The construction rules below are determined with respect to the features of the bottom 12 according to the third embodiment according to the invention illustrated in FIGS. 10 to 12:

- 10% w≤dc≤30% w, preferably with dc=20% w;
- 2 y≤x≤3.5 y, preferably with x=2.4 y;
- 25% t≤x≤70% t, preferably with x=38% t;
- 12.5°≤a≤35°, preferably with a=26°;
- 30% w≤y≤45% w.

The above rules make it possible to obtain a bottom 12 having a continuous seating surface for a flat container 1, that is to say one which comprises a bottom 12 with an oval contour, starting from a blank made of plastics material and by virtue of a blow-molding or stretch-blow-molding manufacturing process, without boxing of the blank.

Figure 9:
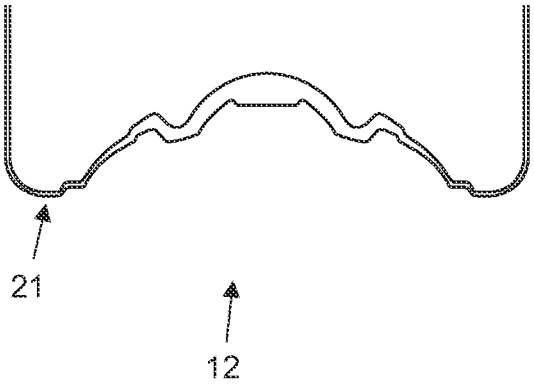
FIG. 9 is a schematic depiction in a transverse section of the bottom of the second embodiment illustrating the distribution of the plastics material by virtue of the shape of the bottom.

As illustrated in FIG. 9, the bottom 12 of the container 1 according to the invention has, by virtue of these features, a specific distribution of the plastics material following the blow-molding of the blank in its transverse distribution. This specific distribution makes it possible to have a similar quantity of plastics material at the seating surface around the entire perimeter of the seating surface. Specifically, the bottom 12 does not have an accumulation of plastics material at the seating surface at the short sides of the container 1.

Thus, the quantity of plastics material located transversely in the seating surface does not constitute an overthickness likely to cause imbalances or a structural instability of the container with respect to the quantity of material located at the longitudinal ends of the seating surface.

What is claimed:

1. A container (1) made of plastic material, provided with a body (11) and with a bottom (12) in a continuation of the body (11) at a lower end of the body (11), the bottom (12) having an oblong curved contour and comprising:

- a seating surface (21) forming a standing plane (210) of the container, the standing plane having an oblong curved shape extending along a longitudinal median axis (ML) and a transverse median axis (MT), the seating surface (21) having a width (W), with a value w, between its distal ends along the transverse median axis (MT);

an arched area (22) extending from the seating surface (21) as far as a central zone (23) of the bottom (12), the arched area (22) delimiting a concavity from an outside of the container (1); the container (1) having a central axis (C) on which the central zone (23) is centered, wherein:

the seating surface (21) has width reductions that are situated on each side of the longitudinal median axis (ML), at least at an intersection between the seating surface (21) and the transverse median axis (MT), the arched area (22) has, for each width reduction of the seating surface (21), for one part, an indentation (4) extending along an entire length of said width reduction of the seating surface (21) and forming a concavity from the outside of the container (1), and, for another part, a curved portion (220) extending directly from said indentation (4) in the direction of the central zone (23), and wherein the arched area (22) has, between the central zone (23) and a width reduction of the seating surface (21), at least one bulge (3) extending longitudinally and forming, from the outside of the container (1), a concavity in the arched area (22).

2. The container (1) as claimed in claim 1, wherein the curved portion (220) extending directly from said indentation (4) in the direction of the central zone (23) has, in a section plane passing through the central axis (C) and the transverse axis (MT), a section in the form of a circular arc inscribed in a circle (Cc), the center of which is situated at a distance (DC), with a value dc, from the central axis (C) along the transverse median axis (MT), with $0.1\ w \leq dc \leq 0.3\ w$.

3. The container (1) as claimed in claim 1, wherein the bulge (3) has a front face (31) proximal to the central zone (23), a rear face (34) distal from the central zone, and, in between, a flat (32), the rear face (34) being curved in the direction of the seating surface (21), the rear face (34) forming all or part of one of the curved portions (220).

4. The container (1) as claimed in claim 3, wherein the bulge (3) has, at the front face (31), a height (H), with a value h, with $0.7\ mm \leq h \leq 2.3\ mm$.

5. The container (1) as claimed in claim 4, wherein the bulge (3) has an offset (33) positioned between its flat (32) and its rear face (34), and wherein, in a transverse section, the front face (31), the flat (32) and the offset (33) together create a crenelated shape, and wherein, at the offset (33), the bulge (3) has a height (G), with a value g, with $g<h$.

6. The container (1) as claimed in claim 3, wherein the bottom (12) comprises, between mutually facing bulges (3) and centered on the central zone (23) of the bottom (12), a dome (5), the profile of which, parallel to the standing plane, is an elongate oblong shape along the longitudinal median axis (ML) and which creates, from the outside of the container (1), a concavity in the arched area (22).

7. The container (1) as claimed in claim 1, wherein the bottom (12) comprises, between mutually facing bulges (3), and centered on the central zone (23) of the bottom (12), a dome (5), a profile of which, parallel to the standing plane, is an elongate oblong shape along the longitudinal median axis (ML) and which creates, from the outside of the container (1), a concavity in the arched area (22).

8. The container (1) as claimed in claim 7, wherein the dome (5) comprises:

along the longitudinal median axis (ML), a maximum length (X), with a value x; and along the transverse median axis (MT), a maximum width (Y), with a value y, with $2\ y \leq x \leq 3.5\ y$.

9. The container (1) as claimed in claim 1, wherein the arch arched area (22) comprises four branches (6) that frame each bulge (3) in pairs, each branch (6) extending along an extension axis (EX) from a dome (5) to the seating surface (21), forming, from the outside of the container (1), a protuberance from the arched area (22), and wherein, for each bulge (3), a flat (32) has a length (P), with a value p, along the longitudinal median axis (ML), and the seating surface (21) has a length (T), with a value t, between its distal ends along the longitudinal median axis (ML), with $20\%\ t \leq p \leq 40\%\ t$.

10. The container (1) as claimed in claim 9, wherein, in a view of the bottom (12) from below, each extension axis (EX) of a branch (6) forms, with the transverse median axis (MT), an angle (β), with a value b, with $50° \leq b \leq 63°$, preferably with $b=57°$, and wherein the extension axes (EX) of two branches (6) on opposite sides of the longitudinal median axis (ML) cross one another on the longitudinal median axis (ML) at a point (R), the two points (R) being spaced apart from one another by a distance (Z), with a value z, with $0.12 \leq z/t \leq 0.35$.

11. The container (1) as claimed in claim 1, wherein the bottom (12) comprises, between mutually facing bulges (3), and centered on the central zone (23) of the bottom (12), a dome (5), the profile of which, parallel to the standing plane, is an elongate oblong shape along the longitudinal median axis (ML) and which creates, from the outside of the container (1), a concavity in the arched area, each curved portion (220) extending as far as the dome (5).

12. The container (1) as claimed in claim 1, wherein, in a view of the bottom (12) from below, the bottom (12) comprises:

a distance (D) with a value d along the transverse median axis (MT) between the middle of a flat (32) of each bulge (3) and a central point (C) at which the transverse median axis (MT) and the longitudinal median axis (ML) cross one another; and a distance (L) with a value 1 between the central point (C) and each distal end of the seating surface (21) along the transverse median axis (MT), with $40\%\ 1 \leq d \leq 65\%\ 1$.

13. The container (1) as claimed in claim 1, wherein, for each bulge (3) and in a median transverse section of the bottom (12), a rear face (34) comprises:

an initial portion (341) adjacent to a flat (32), the initial portion (341) extending parallel to the arched area (22); a terminal portion (342) adjacent to the seating surface (21), the terminal portion (342) forming, at its intersection with the seating surface (21), an angle, with a value a, with a straight line perpendicular to the transverse median axis (MT) and inscribed in the median transverse section of the bottom (12), with $12.5° \leq a \leq 35°$.

14. The container (1) as claimed in claim 1, wherein, for each bulge (3), a flat (32) has a length, with a value p, along the longitudinal median axis (ML), and the seating surface (21) has a length, with a value t, between its distal ends along the longitudinal median axis (ML), with $40\%\ t \leq p \leq 65\%\ t$.

15. The container (1) as claimed in claim 1, wherein each curved portion (220) has a granular texture.

16. The container (1) as claimed in claim 1, wherein: each indentation (4) has a length (E), with a value e, along the longitudinal median axis (ML); and the seating surface (21) has a length (T), with a value t, between its distal ends along the longitudinal median axis (ML); with 65% t≤e≤75% t.

17. The container (1) as claimed in claim 1, wherein, along the transverse median axis (MT), each width reduction of the seating surface (21) has a width (U), with a value u, the seating surface (21) having a residual width (O), with a value o, with 10% (o+u)≤u≤o.

18. The container (1) as claimed in claim 1, wherein the seating surface (21) has a width, with a value w, between the distal ends of the seating surface along the transverse median axis (MT), and wherein the dome (5) comprises along the transverse median axis (MT), a maximum width (Y), with a value y, with 30% w≤y≤45% w.

19. The container (1) as claimed in claim 1, wherein the seating surface (21) has a length, with a value t, between its distal ends along the longitudinal median axis (ML), and wherein the dome (5) comprises along the longitudinal median axis (ML), a maximum length (X), with a value x, with 25% t≤x≤70% t.

20. A mold for manufacturing a container (1) by blow-molding or stretch-blow-molding a blank made of plastics material, the mold comprising a mold bottom having an upper molding surface which corresponds to and impression of the bottom (12) of the container (1) as claimed in claim 1.

* * * * *